United States Patent [19]

Eads

[11] 4,218,903

[45] Aug. 26, 1980

[54] LOCK MECHANISM

[75] Inventor: Charles L. Eads, Palm Springs, Calif.

[73] Assignee: Adams Rite Manufacturing Co., Glendale, Calif.

[21] Appl. No.: 897,180

[22] Filed: Apr. 17, 1978

[51] Int. Cl.[2] ..... E05B 59/00; E05B 63/14; E05B 65/02; E05B 65/06

[52] U.S. Cl. ..... 70/107; 70/111; 70/139; 70/DIG. 6; 292/200

[58] Field of Search ..... 70/107, 110, 111, 123, 70/139, 152, 467, 483, DIG. 6; 292/200

[56] References Cited

U.S. PATENT DOCUMENTS

| | | | |
|---|---|---|---|
| 2,854,839 | 10/1958 | Eads | 70/139 |
| 3,695,068 | 10/1972 | Eads et al. | 70/107 |
| 3,899,906 | 8/1975 | Bradstock | 70/139 |
| 4,127,016 | 11/1978 | Ibsen | 70/139 |

FOREIGN PATENT DOCUMENTS

| | | | |
|---|---|---|---|
| 515841 | 11/1920 | France | 70/467 |
| 1300897 | 7/1962 | France | 70/107 |

*Primary Examiner*—Roy D. Frazier
*Assistant Examiner*—Carl F. Pietruszka
*Attorney, Agent, or Firm*—Whann & McManigal

[57] ABSTRACT

A lock mechanism particularly for doors having a narrow stile, wherein a unique arrangement of components provides greater security and facilitates manufacture and installation, as characterized by a heavy pivotally swingable main bolt connected at its inner end to one end of a rocker actuating lever, the end of the lever being provided with a unique escapement for the release and control of the movement of the rocker arm by an associated manually rotatable key-actuated cam extension, to move the main bolt between locked and unlocked positions. An important feature of the escapement resides in a unique arrangement of parts which is not critical as to the dimensions of the actuating cam extension, and which readily accommodate to actuating cams that may vary materially in their dimensions. The escapement also enables a better and more symmetrical resolution of the operating forces and the obtainment of maximum security. The lock mechanism also includes an improved latching assembly operatively associated with the main bolt lock mechanism to provide both locking and latching operations, respectively, by means of a locking bolt and a latch member, and wherein the latch member is spring-urged to a latched position and is independently operable to an unlatched position. The locking bolt is also arranged to be key-actuated in a normal manner, the key being also further operable, in an unlocked position of the locking bolt, to move the latch member to a retracted or unlatched position.

24 Claims, 14 Drawing Figures

LOCK MECHANISM

BACKGROUND OF THE INVENTION

The present invention relates generally to the field of locks.

Heretofore, it has been known generally from U.S. Pat. Nos. 2,854,839; 3,695,068 and 3,899,906 to provide locking mechanisms of the pivoted or swinging bolt type for mounting in the narrow stile of a door, and the present invention constitutes an improvement over the lock mechanisms disclosed in these patents.

The mechanism in the above-mentioned U.S. Pat. No. 2,854,839 disclosed an early concept in the development of a narrow stile mountable lock of a type which produced features which permitted the obtainment of maximum security. This lock utilized a relatively long main bolt actuating lever which was pivoted at one end and connected at its other end to the lock bolt, the lever mounting a releaseable detent latch between its ends which cooperated with adjacently disposed slots to provide the deadlocking operations of the main bolt. This lock was limited for use with key-actuated lock cylinder assemblies of the casement type, and which are threadedly secured to a side plate of the lock mechanism casing. A notable advantage of the lock mechanism as disclosed in this patent resides in the design arrangement wherein the swingable end of the actuating lever that is connected to the main bolt is in a configuration which permits the bolt-connected end to move symmetrically to positions lying on opposite sides of a center line connecting the pivots of the actuating arm and the main bolt, and thus contribute to a desirable and effective distribution of the operating forces.

In the later U.S. Pat. No. 3,695,068, the operating advantages of the preceding patent have been retained and incorporated into an improved combination locking and latching assembly which is similarly adapted for narrow stile mounting. In the combination locking and latching arrangement of this patent, the latch member is spring-urged to a latched position and is independently operable by a latch handle, knob or the like to an unlatched position, while the locking bolt is arranged to be actuated in a normal manner by a key-actuated cam, the key-actuated cam being further operable, in an unlocked position of the main locking bolt, to move the latch member to a retracted or unlatched position.

Both of these patents, therefore, were limited to the use of the casement type of key-actuated lock cylinder assemblies. At a more recent date, the cam actuator of the insert type was gaining favor in many countries of the world, and the lock mechanism of U.S. Pat. No. 3,899,906 is designed to take advantage of the features of the insert type of cam actuator. In the lock mechanism of this patent, the configuration of the bolt actuating lever was changed to make use of a rocker lever instead of an actuating lever which was pivoted at one end. This change had the manifest advantage of permitting the use of the insert type of cam cylinder assembly, but because of the particular type of releasable latch mechanism for operation by the cam arm, the movement of the end of the rocker arm, which is connected to the swingable bolt, departed somewhat from those of the previous patents in that the arm did not move to limit positions which were symmetrically and substantially equally disposed on opposite sides of a center line connecting the arm and bolt pivots.

In accordance with the features of the present invention, it is proposed to modify the structure of the actuating lever for the main bolt, and utilize a new escapement concept at the end of the rocker arm which is associated with the actuating cam, so that in effect, the end of the rocker arm which is connected to the main bolt will be moved or swung to positions symmetrically disposed on opposite sides of a center line connecting the bolt and actuating lever pivots, during actuation of the main bolt between its unlocked and locked positions. A unique escapement concept, which may be referred to as the "EADS" escapement, has additional advantages over the previous arrangements in that it utilizes an end projecting arm which is engageable by the actuating cam arm during the operation of the locking mechanism. Thus, by utilizing the engagement of two "male" members rather than an arrangement in which the camming arm or single male member must be moved into a recess or the like of a "female" member, it is possible to utilize a variety of camming members which may vary considerably in their dimensions.

Another feature of the present invention resides in the arrangement of an interrelated latching mechanism for operation with the new actuating arm and escapement concept of the present invention.

SUMMARY OF THE INVENTION

The present invention relates generally to lock mechanisms and is more particularly concerned with improvements in the means for actuating and controlling the main lock bolt and an associated latch bolt for use in doors having a narrow stile.

It is one object of the herein described invention to provide a lock mechanism of the type used for doors having a narrow stile, and in which a unique arrangement of the components provides for a greater security, more economical manufacture, and ease and flexibility of installation.

A further object is to provide a lock mechanism of the foregoing character which utilizes an improved rocker actuating lever for the main bolt, in which one end is associated with a key-actuated cam member of the insert type, and wherein the cam member operatively is associated with a unique escapement mechanism for controlling the actuation of the rocker lever to move the main bolt between unlocked and locked positions.

A further object is to provide a maximum security lock mechanism which embodies a unique escapement having a male member which is engaged by a male key-actuated member such as a cam arm, thus enabling the use of a variety of actuating cams which may vary considerably as to dimensions, without affecting the operating capabilities of the escapement.

A still further object is to provide an improved latching mechanism in association with the improved locking mechanism, to provide a greater degree of security, and yet permit the selective operation of the locking and latching mechanisms by means of a key-actuated lock cylinder assembly of the insert type.

Another object is to provide a locking mechanism in which a rocker lever arm is utilized to actuate a main bolt between unlocked and locked positions, and wherein means are provided to automatically vary the mechanical advantage of the rocker lever to provide increased leverage when moving the main bolt out of its unlocked and locked positions.

Still another object is to provide in connection with a locking mechanism of the type described herein, a unique slide stop to prevent key removal except at the fully unlocked and fully locked positions of the main bolt.

Yet another object is to provide in a locking mechanism having an associated latch bolt, a unique manually operable releaseable dogging means for dogging the latch bolt in a retracted unlatched position.

Further objects of the invention will be brought out in the following part of the specification, wherein detailed description is for the purpose of fully disclosing the invention without placing limitations thereon.

BRIEF DESCRIPTION OF THE DRAWINGS

Referring to the accompanying drawings, which are for illustrative purposes only.

DESCRIPTION OF THE PREFERRED EMBODIMENT MAIN LOCKING MECHANISM

Figure 1:
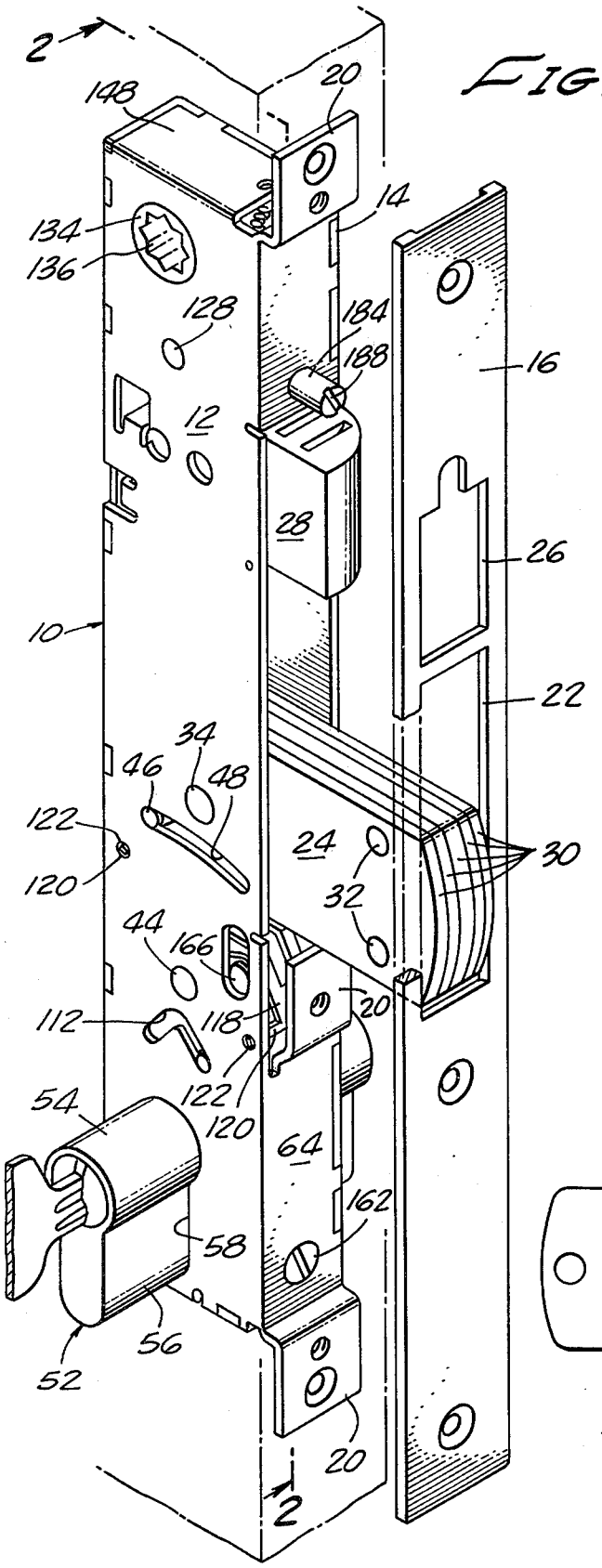
FIG. 1 is a perspective view of a locking mechanism embodying the features of the present invention.

For illustrative purposes, there is disclosed in FIG. 1 a lock casing which is designated generally by the numeral 10. This casing is stamped or otherwise formed to provide companion sections which are staked or otherwise interconnected to form a substantially closed housing within which the locking mechanism is contained between side wall portions 12 and 14. At the forward side of the casing, a face plate 16 is arranged for attachment by means of suitable screws 18 to associated casing lugs 20. Thus the face plate is formed to provide a rectangular slot or opening 22 for a main locking bolt 24, and an adjacent slot or opening 26 for a latching bolt 28. It is to be understood that the main bolt 24 and latching bolt 28, in their locked and latched positions are adapted to be associated with appropriate keepers mounted on an associated door jam or other door.

The main bolt 24 is preferably of laminated construction and consists of a plurality of metallic plates 30 secured in overlying or stacked relation by means of suitable rivets 32 or other conventional means. While the main bolt has in this instance been illustrated as of the straight type, it is contemplated that this bolt may, if desired, be of the hook type. The bolt is pivotally mounted for swinging movements through an angle of substantially 90° between its extended locked position and retracted unlocked position, a pivot pin 34 being positioned to extend through the inner end of the bolt and have its opposite ends rigidly supported in the side walls 12 and 14, respectively, of the casing.

The main locking bolt 24 is provided at its inner end with transversely aligned L-shaped slots 36 with dwell positions at their ends, as indicated by the numerals 38 and 40, respectively. The slot 36 is oriented so that its long leg extends generally in a radial direction from the pivot pin 34.

The bolt 24 is arranged to be actuated between its retracted unlocked position and extended locked position by means of an actuating rocker lever 42 which extends generally in a longitudinal direction of the casing 10 and is supported between its ends on a pivot 44 for a rocking movement. One end of the lever 42 mounts a transversely extending pin 46 having its ends respectively positioned on opposite sides of the lever and extending into the bolt slots 36,36 for movement therein. The rocking movement of the lever is thus constrained, and the slots 36 are so shaped as to accommodate relative movements of the pin and the bolt during operative movements of the actuating lever in moving the bolt between its retracted and extended positions. As shown, the ends of the pin 46 are also positioned for movement respectively in transversely extending arcuate guide slots 48 formed in the opposite side walls 12 and 14 of the casing. As thus arranged, the movements of the pin 46 to the opposite ends of the slots 48 operate to dog the main bolt 24 in a deadlocked position at its unlocked and locked positions, respectively.

Figure 2:
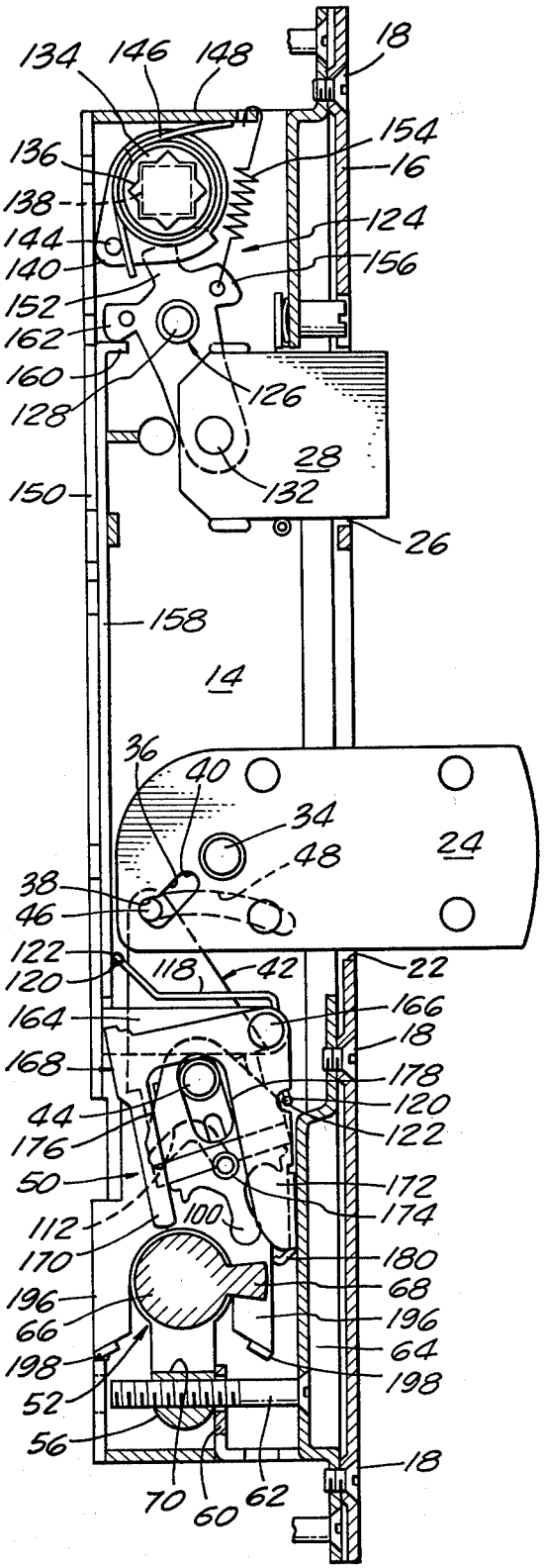
FIG. 2 is a longitudinal sectional view, taken substantially on line 2—2 of FIG. 1, showing the cooperative relationship of the lock components, the main bolt being in extended locked position.
Figure 3:
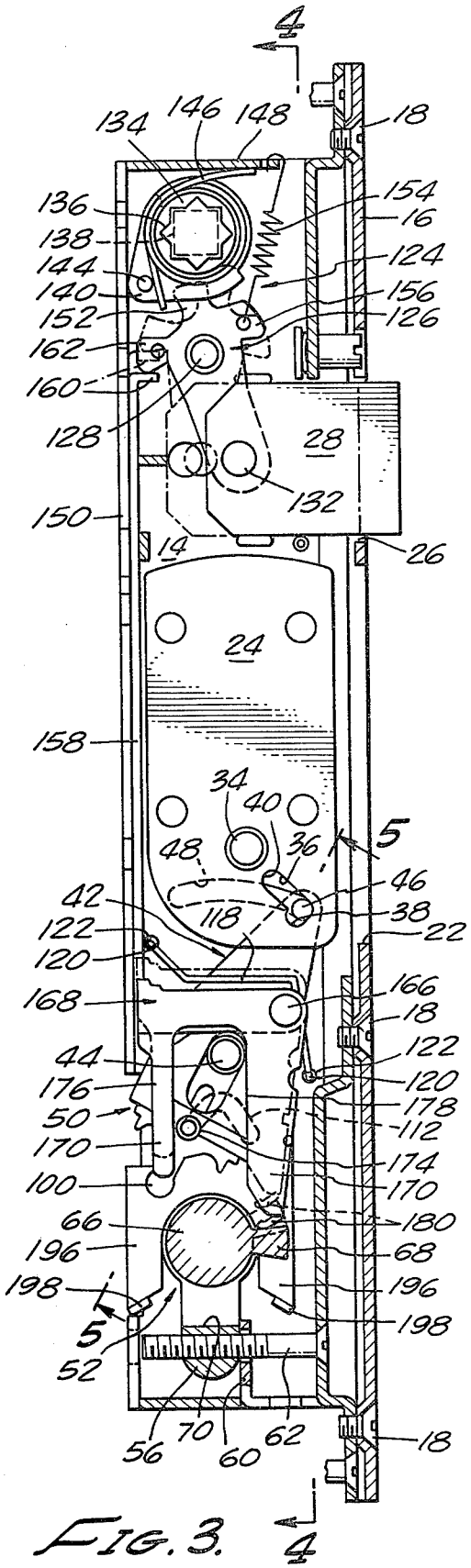
FIG. 3 is a view similar to FIG. 2, except that the bolt is shown in retracted unlocked position.

As generally indicated in FIGS. 2 and 3, the opposite end of the rocker lever 42 carries on Eads escapement mechanism as generally indicated by the numeral 50, which is operatively associated with a key-controlled lock cylinder 52 of the insert type rather than the casement type which is threadedly mounted in the casing of the lock mechanism. As shown, the lock cylinder has a body structure of generally keyhole configuration, the body having a cylindrical portion 54 and a radially extending depending projecting portion 56. The body portion is insertable endwise through aligned keyhole-shaped openings 58, respectively formed in the side walls 12 and 14 of the casing 10. In its operative position, the lock cylinder assembly has a projecting portion 56 secured to an upstanding lug 60 by means of a retaining screw 62 which is insertable through an opening in a front wall portion 64 of the casing.

The lock cylinder assembly includes a rotatable member 66 which carries a radially projecting cam extension arm 68 having a path of movement which passes through an opening 70 in the projecting portion 56 during its movement from one side to the other of the assembly body. Actuating forces will be applied to the escapement mechanism 50 in a manner to operate the main bolt through rocker lever 42 in a manner to move the main bolt between its unlocked and locked positions of operation, in a manner which will hereinafter be explained more fully.

The "Eads" Escapement Mechanism

The escapement mechanism 50 is an important feature of the herein disclosed invention which provides improved operating features which contribute to a balancing of operating forces in a manner to augment and enhance the maximum obtainable security features of the locking mechanism. Further, the escapement is such that the opposite end of the rocker lever 42 will be varied during its operation so as to automatically vary the mechanical advantage of the rocker lever and provide increased leverage when moving the main bolt out of its unlocked and locked positions. Also, the escapement is such that a variety of cam extension arms 68, may vary considerably as to their dimensions, and operate with complete effectiveness to move the rocker lever as necessary to change the position of the main bolt between its unlocked and locked positions. These features will become more evident during the following description of the escapement mechanism.

Figure 6:
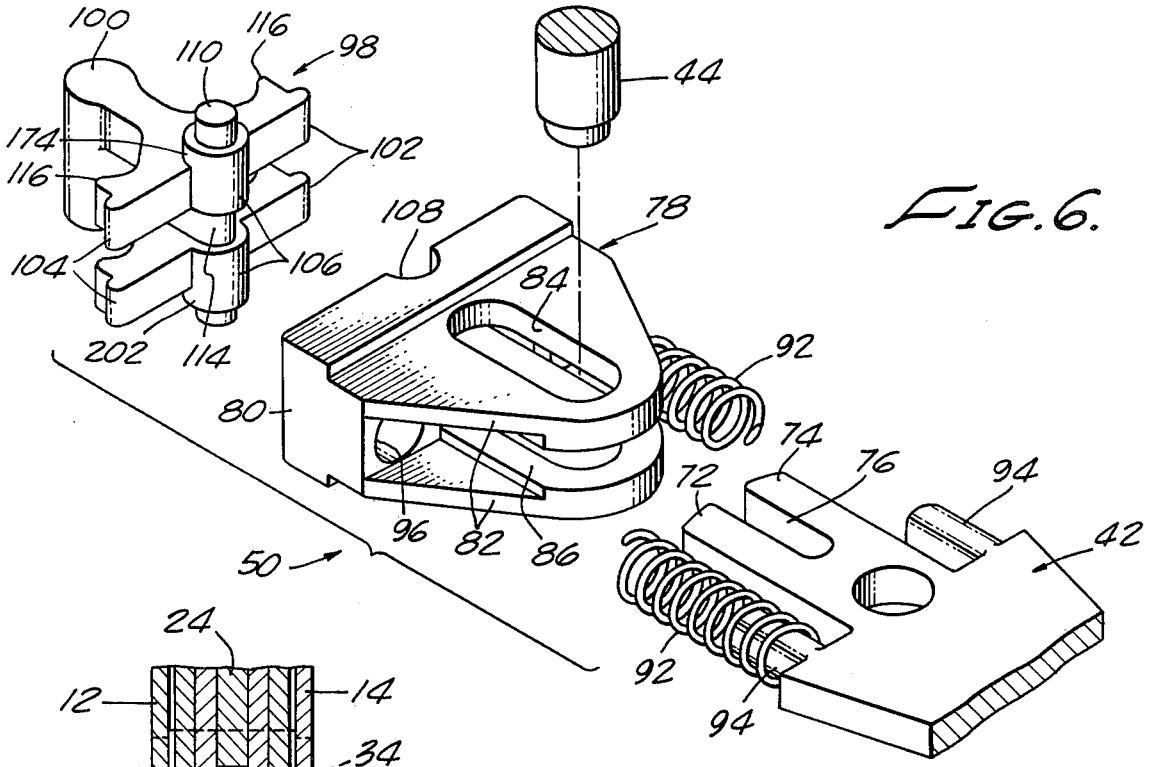
FIG. 6 is an enlarged fragmentary perspective exploded view, showing the components of the Eads escapement.
Figure 5:
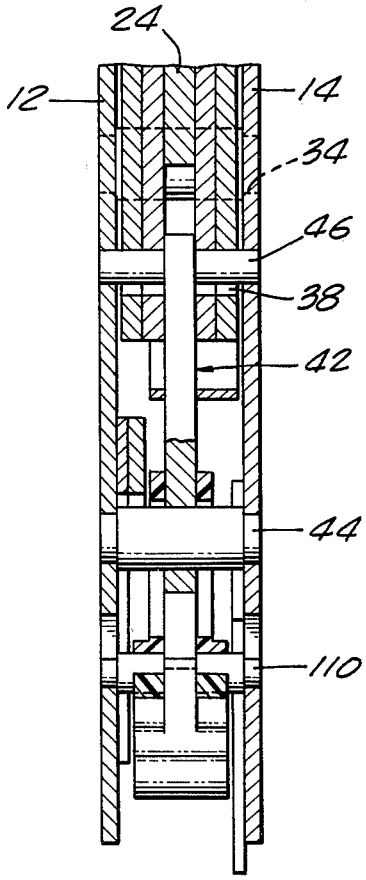
FIG. 5 is an enlarged fragmentary transverse sectional view, taken substantially on line 5—5 of FIG. 3, showing details of the rocker lever and the escapement.

More specifically, as shown in FIG. 6, the opposite end of the rocker arm 42 is fabricated to provide a pair of laterally spaced projecting parallel arms 72, 74 which coact to provide an axially extending open ended slot 76. The arms 72 and 74 are arranged to guidingly support escapement slide member 78 thereon for reciprocal sliding movements between inner and outer limit positions.

The escapement slide member 78 comprises a generally rectangular body head portion 80 with integrally formed spaced lugs 82 having axially extending guide slots 84 having aligned registration and being adapted to receive the pivot 44 therethrough for guided movement axially thereof. The parallel arms 72, 74 are arranged to extend respectively through guiding channels 86 positioned between the lugs 82, 82 on opposite sides of the guide slots 84. The ends of these arms will protrude through an end opening 88 (FIG. 7) in a transversely extending abutment face 90, when the escapement slide member 78 is moved to its inner limit position on the arms 72, 74. A pair of coiled compression springs 92 on opposite sides of the arms 72, 74 are arranged with one end in anchored relation to a retaining projection 94 on the rocker lever 42, while the other end is arranged to be seated in a recess 96 in the head portion of the escapement slide member 78. With such an arrangement, it will be evident that the springs 92 will normally urge the escapement slide member towards its outer limit.

An escapement release member 98 of generally T-shaped configuration is operatively associated with the head portion 80 of the escapement slide member and is composed of an axially extending projecting arm portion 100 which is connected with spaced cross members 102, presenting transversely extending abutment faces 104. These abutment faces are arranged to normally engage the abutment face 90 of the escapement slide member 78, and between their ends are provided with spaced bearing shoulders 106 which are adapted to seat in axially positioned receiving recesses 108 in the abutment face 90, to normally maintain the escapement slide member 78 and escapement release member 98 in axially operative engagement. The escapement release member 98 is also supported for relative pivotal movement with respect to the escapement slide member 78 by means of a pivot member 110 having its opposite ends supported for guided lateral movements within transversely registering inverted V-slots 112 formed in the casing side walls 12 and 14. When the escapement slide member 78 and the escapement release member 98 are in axially aligned engagement with the bearing shoulders 106 in the receiving recesses 108, the escapement slide member 78 and the escapement release member 98 are coupled for a unitary movement between inner and outer limit positions of the escapement slide member. Upon movement of the coupled escapement members from the outer limit position towards the inner limit position, the parallel arms 72 and 74 will straddle a central wall portion 114 between the cross members 102 and thereby interlock the escapement members so as to prevent relative pivotal movement of the escapement release member with respect to the escapement slide member 78. However, when the escapement members are moved to the outer limit position, the parallel arms 72, 74 will be disengaged with respect to the central wall portion 114, and in such case enable relative pivotal movement of the escapement release member 98 in a manner such that the escapement slide member will be urged axially away from the escapement release member by the camming action of the cross members 102.

Figure 9:
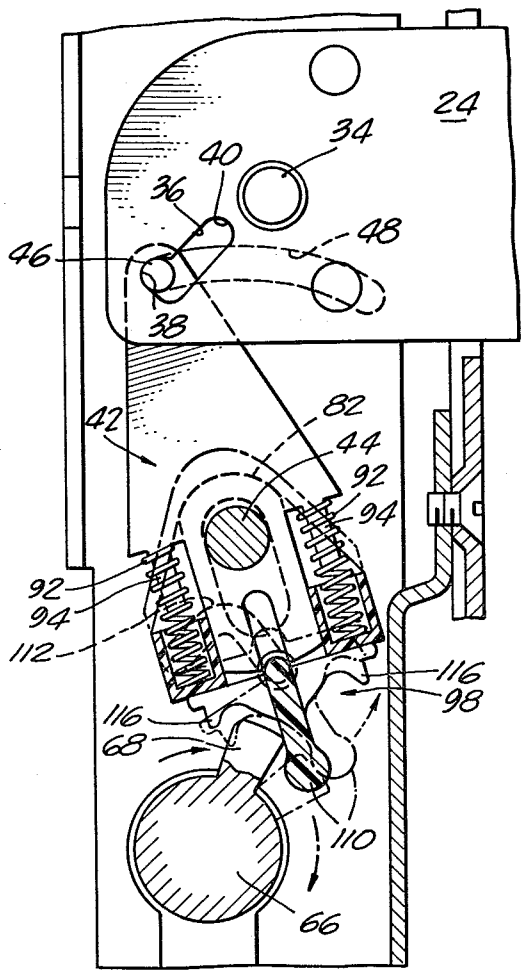
FIGS. 7, 8 and 9 are enlarged fragmentary transverse sectional views respectively illustrating the operative positions of the escapement mechanism in the unlocked, intermediate and locked positions of the main bolt.
Figure 8:
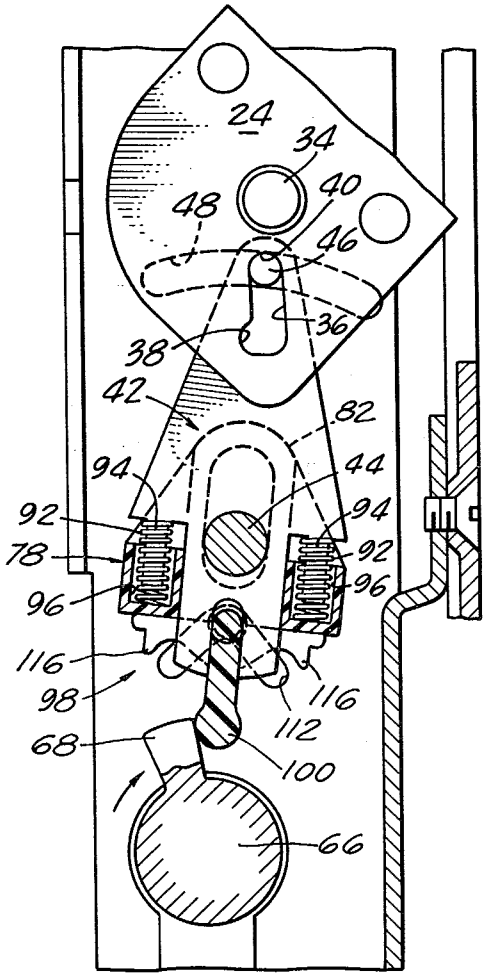
Figure 7:
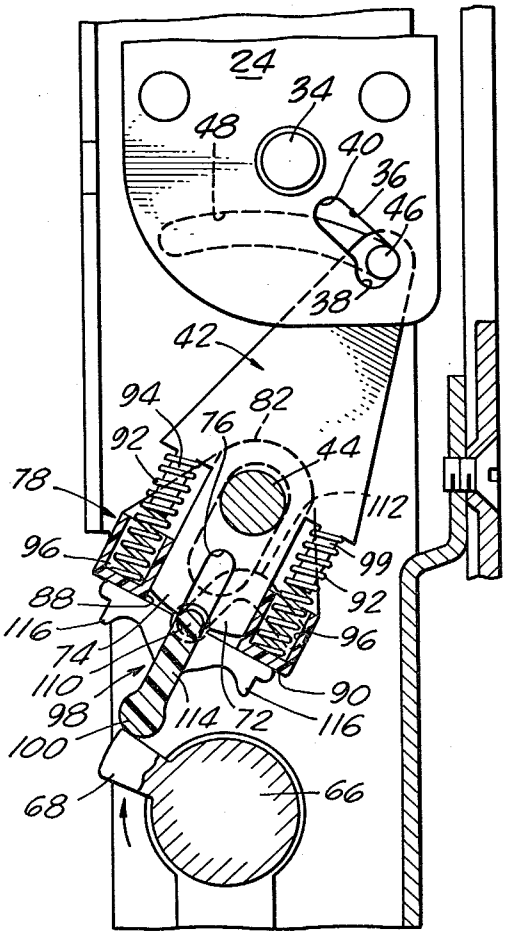

The operation of the escapement mechanism 50 is best shown in FIGS. 7, 8 and 9 of the drawings. In FIG. 7, the position of the rocker lever 42 with the escapement mechanism is shown for the position in which the main bolt 24 is in an unlocked position. In this position, it will be seen that the rocker lever 42 is upwardly inclined to the right and that the pivot member 110 of the escapement release member 98 will be disposed at the bottom of the left leg of the V-slot 112. In order to actuate the main bolt 24 to a locked position, the cam extension arm 68 will be rotated in a clockwise direction. This rotation will bring the cam extension arm into engagement with the outer end of the arm portion 100. It will be observed that the position of the arm 100 is such that the cam extension arm 68 will apply a predominant axial acting force against the arm 100, which will be effective upon continued movement of the cam 68 to move the pivot 110 to a mid-operating position as shown in FIG. 8, and at the same time activate the main bolt to a mid-position. During this movement, the escapement release member will be interlocked against pivotal movement with the arms 72, 74. The arm 100 will also be moved in a radial direction towards the pivot 44 against the action of the springs 92. During the action, the arm 100 will have moved from its maximum extended position in which the mechanical force of the rocker lever 42 will be the greatest with respect to the operation of the main bolt 24.

At the mid-position, as shown in FIG. 8, the cam extension arm 68 will now engage the side portion of the end of arm 100 so as to apply a predominant lateral force against the arm and move it into the downwardly inclined right leg of the V-slot 112, the arm now being so positioned with respect to the cam extension arm that the urging force of the springs 92 is now effective to complete the movement of the pivot member 110 to the right bottom end of the slot, and during this movement operate to cam the rocker lever to an inclined position to the left, as shown in FIG. 9, in which the main bolt will be in its locked position.

Referring further to FIG. 9, it will be seen that in this position, the arm 100 is disposed in a blocking position to the further movement of the cam extension arm 68. However, the escapement release member 98 is at its outer limit or escapement operative position, since it is no longer in locked engagement with the arms 72, 74. At this time, reverse movement of the cam extension arm 68 is prevented by an abutment projection 116, but movement of the cam extension arm in a clockwise direction may now be permitted by the pivotal action of the arm portion 100 which will be moved to the escapement position shown in phantom lines and permit passage of the cam extension arm. During the escapement movement of the arm 100, it will be seen that the escapement release member 98 will be pivotally tilted and cam the escapement slide member 78 towards its inner position against the action of the springs 92. Upon passage of the cam extension arm 68, the arm 100 will be urged back into its axial position as shown in full lines, where it will be engaged by reverse rotation of the cam extension arm 68 to apply a predominant axial acting force to shift the main bolt from its locked to unlocked position by a reversal of the operations previously described for moving the main bolt from its unlocked to fully locked position.

Figure 4:
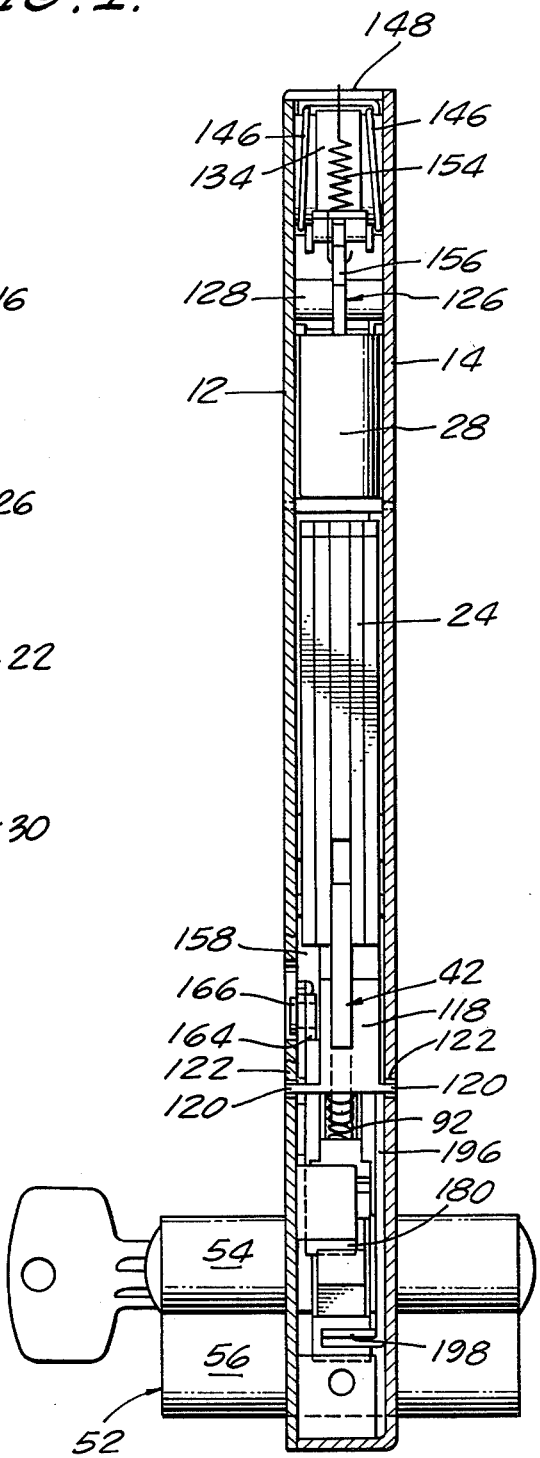
FIG. 4 is a longitudinal sectional view, taken substantially on line 4—4 of FIG. 3.

As best shown in FIGS. 1, 2 and 4, an internal barrier 118 is mounted within the lock casing to prevent the insertion of a probe or other instrument through the slot or opening 22 and the surreptitious operation of the escapement mechanism in a manner to effect operation of the main bolt. The barrier 118 has end projections 120 which are adapted to seat in receiving openings 122 in the side walls 12 and 14 of the casing.

The Latching Mechanism

Figure 11:
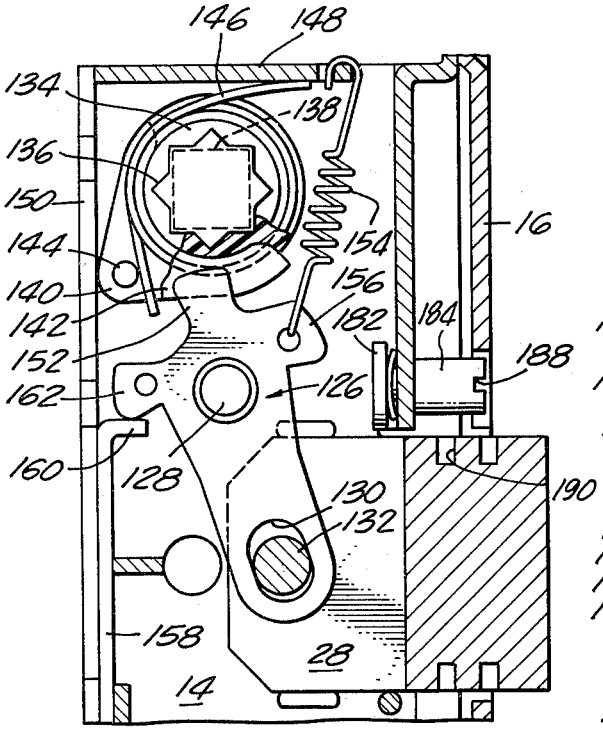
FIGS. 11 and 12 are enlarged fragmentary transverse sectional views respectively showing the operative relationship of the latching mechanism with the latch bolt in extended and retracted positions.
Figure 12:
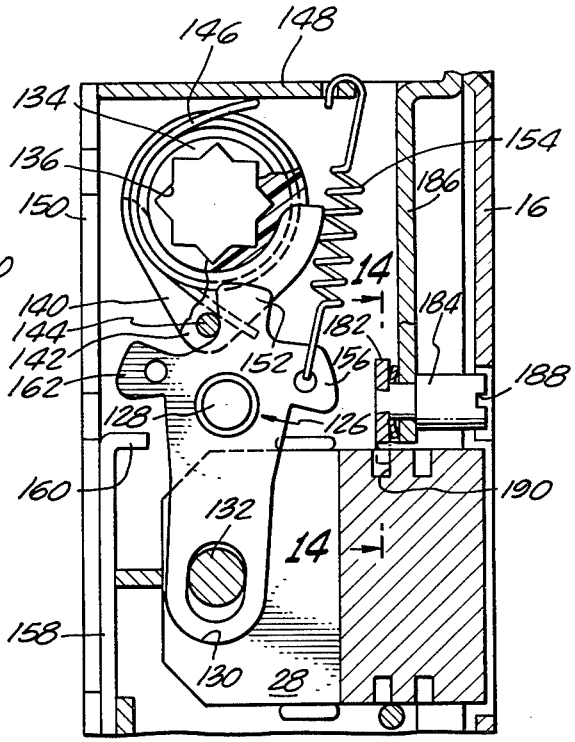
Figure 13:
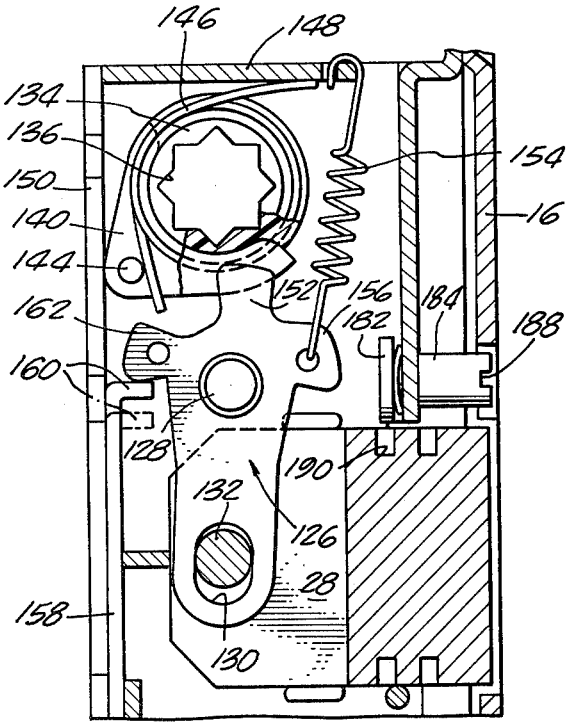
FIG. 13 is a view similar to that of FIG. 12, and showing the operative position of the latch actuator bar in shifting the latch bolt from the latch position shown in FIG. 11, to an unlatched position.

The latch bolt 28 and its connected operating mechanism, as generally indicated by the numeral 124, are shown as being located in a position above the main bolt 24. As best shown in FIGS. 11, 12 and 13, the latching mechanism comprises an actuator rocker lever 126 which is supported intermediate its ends by a fixed pivot 128 having its opposite ends respectively supported in the casing side walls 12 and 14. One end of the rocker lever 126 is connected with the inner end of the reciprocably mounted latching bolt 28, this end of the lever being provided with an end slot 130 which has a connecting pin 132 movably positioned therein. Swinging movements of the rocker lever 126 are operative to move the latching bolt 28 between an extended latching position (FIG. 11) and a fully retracted unlatched position (FIG. 12).

Provision is made for selectively operating the latch bolt by manual operable means at the latch bolt position, as well as by the key means utilized for the actuation of the main bolt 24. In the first of these, there is provided a suitable hub member 134 which has its respective ends rotatably supported in the side walls 12 and 14 of the lock casing. This hub is provided with an internal bore 136 permitting splined connection with a square shaft 138, as shown in dotted lines, of an external knob, handle or other manually operable exterior member (not shown).

The hub member 134 has a pair of axially spaced peripherally radially projecting lugs 140 and 142, and which at their outer ends are bridged by a pin member 144. A pair of coiled springs 146 (FIG. 4) respectively surround the outermost ends of the hub member 134, one end of the spring in each case being engaged behind the pin member 144, and the other end being engaged with an adjacent top end wall 148 of the casing. Thus, the springs are tensioned and normally urge the hub member 134 in a clockwise direction of rotation, as seen in FIG. 11, towards a stop position in which the outermost end of the lugs 140 and 142 engage a stop which may comprise a rear wall 150 of the lock casing or other appropriate supplemental stop means.

The opposite end of the rocker lever 126 is formed with a generally axially extending end projection 152 which is adapted for movement in the space between the lugs 140 and 142, and is disposed in the path of movement of the pin member 144, when the hub is rotated in a counterclockwise direction. As will be clearly seen in FIG. 11, the rocker arm 126 is normally urged in a direction to move the latching bolt 28 to its latched position by means of a tension spring 154, one end of the spring being anchored to the end wall 148, and the other end being connected with a laterally extending projection 156 having substantially right-angled relation to the end projection 152.

Operation of the latching bolt 28 by the key-controlled lock cylinder 52, when the main locking bolt 24 is in an unlocked position, is accomplished by means of an elongate latch actuator bar 158 positioned adjacent to and extending along the rear wall 150 of the lock casing. The latch actuator bar is supported by reciprocable movement between a lower position as shown in phantom lines and a raised position as shown in full lines in FIG. 13. The upper end of the latch actuator bar 158 is deformed to provide a right-angled end abutment 160 which is associated with and adapted to engage a projection 162 positioned on the opposite side of the pivot 128 from projection 156. With the arm 158 in its lower position, as shown in FIG. 11, the projection 162 is free for rotational movement in a clockwise direction during operation of the latching bolt to a retracted unlatched position by manual rotation of the hub member 134, as shown in FIG. 12. However, when the latch actuating bar 158 is raised to the position shown in full lines in FIG. 13, the end abutment will engage the projection 162 and rotate the rocker lever 126 and move the latching bolt 28 to unlatched position, independently of the hub member 134, as shown in FIG. 13.

The latch actuating bar 158 is constructed at its lowermost end with a right-angled extending arm 164 which at its outermost end is arranged to swingably support on a fixed pivot 166 a generally U-shaped swingable bracket 168 having laterally spaced generally parallel arms 170 and 172 positioned in straddled relationship with pivot 44 and the escapement mechanism 50, as shown in FIGS. 2 and 3. The bracket is arranged to be shifted between an angularly disposed position, as shown in FIG. 2, and an axially aligned position with respect to the latch actuator bar 158, as shown in FIG. 3, by the swinging movement of an annular collar 174 at one end of the pivot 110 into engagement with inner edges 176 and 177 of the arms 170 and 172, respectively, during actuation of the main locking bolt 24 to its unlocked and locked positions.

The arm 172 is formed with an end abutment 180 which is adapted in the angular position of the bracket 168 to occupy an ineffectual position out of the path of travel of the cam extension arm 68, as shown in FIG. 2. Thus, with the main locking bolt 24 in locked position, the cam extension arm 68 is freely movable into engagement with the outer end of the arm portion 100 to effect actuation of the main locking bolt 24 to its unlocked position. However, as shown in FIG. 3, in the locked position of bolt 24 the end abutment 180 will have been moved into a position where it will be engaged by the cam extension arm 68 upon rotation in a counterclockwise direction, and raised to the dotted line position, as shown, which will correspondingly raise the upper end abutment 160 from its dotted line position to a full line position, as shown in FIG. 13, to retract the latch bolt 28. Movement of the cam extension arm from this position in a reverse direction will permit the latch bolt 28 to be urged outwardly by the spring 154 to its latched position.

Figure 14:
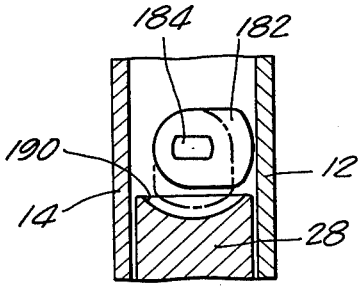
FIG. 14 is a fragmentary sectional view showing the operative relationship of the latch bar and associated dogging cam.

As shown in FIGS. 12 and 14, provision is made for dogging the latching bolt 28 into a releaseable unlatched position by means of a dogging cam member 182 supported at the inner end of a rotatable shank 184 which is rotatably supported in a front casing wall member 186. The outermost end of the shank 184 is provided with a transverse end groove 188 which is accessible to receive a screwdriver by means of which the shank may be rotated to move the outer end of the cam member 182 into an arcuate recess 190 formed in the adjacent edge surface of the latching bolt 28. The bolt will thus be held in its unlatched position, but may be readily released by rotating the shank 184 so as to disengage the dogging cam, whereupon the latching bolt will be automatically urged to its latching position by the action of the spring 154.

The Cam Slide Stop

Figure 10:
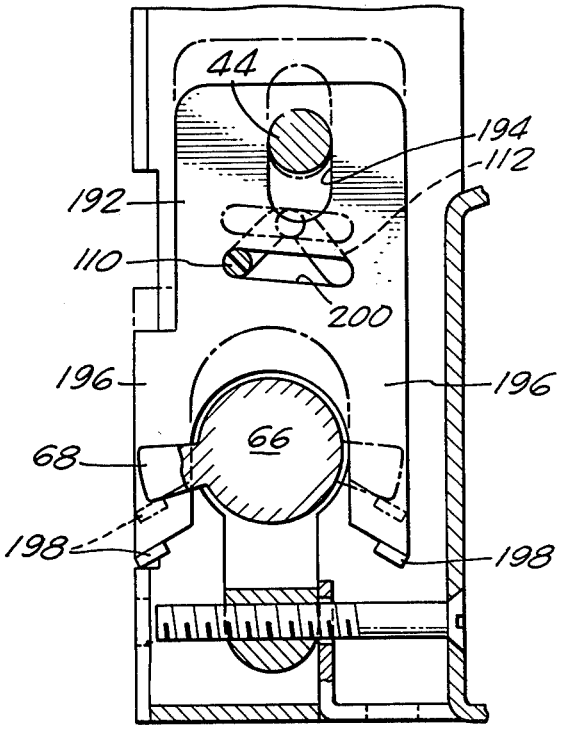
FIG. 10 is an enlarged transverse sectional view showing the operative relationship of the slide stop and cam extension.

The key-controlled lock cylinder 52 is so constructed that the key must be rotated 360° between key removal positions, while the lock mechanism is arranged for movement between unlocked and locked positions by key rotation of substantially 180°. Provision is made for preventing removal of the key in a mid-position of the main bolt, thus necessitating that the bolt be moved to a fully unlocked or fully locked position before the key can be removed. As shown in FIG. 10, a flat plate member 192 is slidably mounted for reciprocal movements in face engagement with the casing side wall 14. At one end, the plate is formed to provide a longitudinally extending guide slot 194 for receiving the pivot 44 therethrough. The opposite end of the plate member is U-shaped to provide parallel spaced apart arms 196 that are in straddling relation to the rotatable member 66 of the key-controlled lock cylinder. The outer end of each arm 196 is provided with an end abutment projection 198. These abutment projections are so arranged that, when the plate member 192 is at its lowermost position as shown in full lines in FIG. 10, the abutments will be positioned out of the path of movement of the cam extension arm 68. This position of the abutments corresponds to the unlocked and locked positions of the main bolt 24. However, when the plate member 192 is moved to its raised position as shown in phantom lines, which corresponds to a mid-position of the main bolt 24, the abutment projections will be disposed and block the path of movement of the cam extension arm. The plate 192 is raised and lowered in response to the actuation of the main bolt 24 between its unlocked and locked positions. The plate 192 is formed intermediate its ends with a transversely extending slot 200 within which there is movably positioned a collar 202 at the adjacent end of the pivot member 110 of the escapement release member 98. Thus, as the pivot 110 is moved from one end of the V-slot 112 to the other in going from a fully unlocked to fully locked position of the main bolt, the flat plate member 192 will be accordingly raised and lowered.

From the foregoing description, it is believed that it will be appreciated that the lock and latch structures described herein accomplish the stipulated objects as set out for the invention.

Various modifications may suggest themselves to those skilled in the art without departing from the spirit of my invention, and hence, I do not wish to be restricted to the specific form shown or uses mentioned, except to the extent indicated.

I claim:

1. A locking mechanism for a movably mounted door having a relatively narrow stile comprising:

(a) a casing structure positionable in said stile adjacent a vertical face thereof;

(b) a bolt supported in said casing for selective movement to a retracted unlocked position within said casing and to an extended locked position;

(c) a bolt actuating lever supported between its ends in said casing for rocking movement on a pivotal axis between angularly disposed bolt operating limit positions, one end of said actuating lever being connected with said bolt;

(d) escapement means carried by the opposite end of said actuating lever for controlling the movements of said lever between said limit positions, including: an extension arm projecting beyond the opposite end of said actuating lever, said arm being supported on said opposite end for relative movements; and (e) lock actuating means including a manually operable element swingably rotatable in opposite directions, and upon rotation in each of said opposite directions being initially engageable with the outer end of said arm at the first of said limit positions, and thereafter actuatable to shift the lever to the second of said limit positions in which the arm is in an escapement operative position blocking the path of movement of said element, whereupon continued movement of the element operates to movably shift the arm relative to the lever to a released position permitting passage of the element.

2. A locking mechanism according to claim 1, in which:

the bolt is supported between its ends for swinging movement on a pivotal axis between said retracted and extended positions;

said one end of said actuating lever is connected by a pivot pin to an inner end portion of said bolt;

said pivot pin having a portion positioned within an arcuate slot formed in an associated wall of said casing and being symmetrically positioned to extend substantially equal distances transversely on opposite sides of a plane including the pivotal axes of said bolt and said bolt actuating lever; and said pivot pin and said arcuate slot coacting to deadlock said bolt respectively in its retracted and extended positions.

3. A locking mechanism according to claim 1, in which:

spring means normally urges said arm towards the escapement operative position.

4. A locking mechanism according to claim 1, in which:

the extension arm is mounted on a pivot member for swinging movement at said escapement operative position in response to the application of a predominant laterally applied force by said manually operable element.

5. A locking mechanism according to claim 4, in which:

the extension arm is connected for longitudinal axial relative sliding movements on said lever in directions towards and away from said escapement operative position in response to application of a predominant axially applied force, said arm during said movements being interlocked with said lever against pivotal movements.

6. A locking mechanism according to claim 5, in which:

spring means urges the arm in the direction towards its escapement operative position, and said manually operable element operates to move the arm in the direction away from its escapement operative position.

7. A locking mechanism according to claim 6, in which:

said spring means also resiliently opposes pivotal swinging movement of said arm to said releases position.

8. A locking mechanism according to claim 5, in which:

said pivot member has a portion positioned for guided lateral movement by said lock actuating means between the ends of an inverted V-slot formed in a wall of said casing, said pivot member and slot coacting to shift said lever from one of said bolt operating limit positions to the other.

9. A locking mechanism according to claim 8, in which:

the manually operable element comprises a key-actuated radially projecting actuating camming arm having rotative movements of substantially 180° between bolt fully unlocked, and key removable positions beyond the 180° movements and bolt fully locked positions;

abutment means normally having a position permitting movement of the camming arm between the fully unlocked and locked positions; and means responsive to the movement of said bolt to an intermediate position between said fully unlocked and said fully locked positions for moving said abutment means into a blocking position in the path of movement of said camming arm such that the camming arm cannot be moved to a key removable position until the bolt is moved to a fully unlocked or fully locked position.

10. A locking mechanism according to claim 9, in which said abutment means comprises:

a slide plate supported for longitudinal sliding reciprocable movements;

said plate being oriented in a flat position overlying said inverted V-slot; and a transverse slot in said plate extending across said inverted V-slot adapted to movably receive therethrough the portion of said pivot that is positioned in said V-slot.

11. A locking mechanism according to claim 10, in which:

said plate has a pair of projecting end arms in straddling relation to the axis of rotation of said camming arm; and abutment surfaces respectively on each of said arms, whereby the movements of the pivot portion in the inverted V-slot also shifts said abutment surfaces between an inactive and an active position with respect to the path of travel of said camming arm.

12. A locking mechanism according to claim 1, in which:

the escapement means further includes a slide member supported on the opposite end of said actuating lever for axial movement between an inner limit position and an outer limit position;

said extension arm having its inner end abutting an outer end of the slide member and being movable therewith as a unit between the inner and outer limit positions;

spring means urging the slide member and extension arm towards the outer limit position;

said extension arm in said outer limit position being free for rotative movement and being operative in response to said rotative movement to move the slide member inwardly away from said extension arm against the force of said spring means; and means for interlocking and holding the extension arm against said rotative movement when the extension arm and slide member are moved as a unit away from said outer limit position.

13. A locking mechanism according to claim 12, in which:

said opposite end of the actuating lever has a pair of laterally spaced projecting parallel arms;

the slide member is axially guided on said arms; and the interlocking and holding means includes said arms, outer end portions of the arms being adapted, when the extension arm and slide member are moved as a unit away from said outer limit position to straddle the inner end of the extension arm.

14. A locking mechanism according to claim 12, in which:

the abuting ends of the extension arm and slide member comprise transversely extending confronting surfaces; and said surfaces are respectively formed with an axial projection and projection receiving recess which coact to axially align the extension arm and slide member when moved as a unit between said inner and outer limit positions.

15. A locking mechanism according to claim 13, in which:

the spring means comprise coiled compression spring members positioned respectively laterally outwardly of said parallel arms; and said springs having one end in engagement with the slide member, and the other end in engagement with an associated part of the actuating lever.

16. A locking mechanism according to claim 14, in which:

the extension arm is of a T-shaped configuration.

17. A locking mechanism for a movably mounted door having a relatively narrow stile, comprising:

(a) a casing structure positionable in said stile, adjacent a vertical edge face thereof;

(b) a main bolt supported in said casing for selective movement to a retracted unlocked position within said casing and to an extended locked position;

(c) a bolt actuating lever structure supported between its ends in said casing for rocking movement on a pivotal axis between angularly disposed bolt operating limit positions, one end of said actuating lever being connected with said bolt;

(d) manually operable lock actuating means selectively operable to coact with the other end of said lever and shift the lever to move said bolt to its unlocked and locked positions; and (e) means operative to vary the effective length of one arm of said lever to provide increased operating leverage at the unlocked and locked positions of said bolt.

18. A locking mechanism according to claim 17, in which:

the means for varying the effective length comprises an axially slidably mounted extension arm projecting from the opposite end of said actuating lever.

19. A locking mechanism according to claim 18, in which:

said extension arm is normally urged towards an extended position.

20. A locking mechanism for a movably mounted door having a relatively narrow stile, comprising:

(a) a casing structure positionable in said stile, adjacent a vertical edge face thereof;

(b) a main bolt supported in said casing for selective movement to a retracted unlocked position within said casing and to an extended locked position;

(c) a bolt actuating lever supported between its ends in said casing for rocking movement on a pivotal axis between angularly disposed bolt operating limit positions, one end of said actuating lever being connected with said bolt;

(d) escapement means carried by the opposite end of said actuating lever for controlling the movements of said lever between said limit positions;

(e) manually operable lock actuating means operable at a first of said limit positions to coact with said escapement means and shift the lever to the second of said limit positions;

(f) latching means including a latch bolt supported on said casing, in spaced relation to said main bolt, for rectilinear movement between a retracted unlatched position and an extended latched position, and being normally urged towards its extended position;

(g) a latch actuator rocker lever is pivoted between its ends, one end being connected to said latch bolt and the other end being formed to provide an axially extending end projection;

(h) other manually operable means adjacent said latch means for actuating said latch bolt to said unlatched position comprising a rotatable hub member having a peripheral abutment element adapted, upon manual rotation of the hub in one direction, to engage said lever end projection and move the latch bolt to a retracted position;

(i) spring means for normally urging said hub member in a rotation direction opposite said one direction to disengage the peripheral abutment member with respect to said end projection; and (j) connection means between said main bolt and said latch bolt, activated in the unlocked position of said main bolt, for enabling actuation of said latch bolt to said unlatched position by means of said manually operable lock actuating means.

21. A locking mechanism according to claim 20, in which:

said other end of the latch actuator lever has lateral projections respectively on opposite sides of said end projection;

one of said lateral projections being connected to spring means for urging the latch bolt to said latched position, and the other of said lateral projections comprises a part of said connection means and being operable to move the latch bolt to said unlatched position.

22. A locking mechanism according to claim 21, which includes:

a reciprocably mounted latch actuator bar positioned generally in the rear of said casing structure, said bar having one end positioned to engage the other of said lateral projections, when moved in one direction, and disengage the same, when moved in an opposite direction.

23. A locking mechanism according to claim 20, which includes:

dogging means comprising a manually rotatable dogging cam member positioned adjacent a surface of said latch bolt; and said latch bolt surface having a recess positioned to releasably receive a portion of said cam member therein, when the latching bolt is in its unlatched position.

24. A locking mechanism for a movably mounted door having a relatively narrow stile, comprising:

(a) a casing structure positionable in said stile, adjacent a vertical edge face thereof;

(b) a main bolt supported in said casing for selective movement to a retracted unlocked position within said casing and to an extended locked position;

(c) a bolt actuating lever supported between its ends in said casing for rocking movement on a pivotal axis between angularly disposed bolt operating limit positions, one end of said actuating lever being connected with said bolt;

(d) escapement means carried by the opposite end of said actuating lever for controlling the movements of said lever between said limit positions;

(e) manually operable lock actuating means operable at a first of said limit positions to coact with said escapement means and shift the lever to the second of said limit positions;

(f) said manually operable lock actuating means comprising a key-actuated radially projecting camming arm supported for rotative movements in opposite directions to effect movement of the main bolt respectively to its unlocked and locked positions;

(g) latching means including a latch bolt supported on said casing, in spaced relation to said main bolt, for movement between a retracted unlatched position and an extended latched position, and being normally urged towards its extended position;

(h) other manually operable means adjacent said latch means for actuating said latch bolt to said unlatched position;

(i) connection means between said main bolt and said latch bolt, activated in the unlocked position of said main bolt, for enabling actuation of said latch bolt to said unlatched position by means of said manually operable lock actuating means;

(j) said connection means including an elongated latch actuator bar mounted at the rear of said casing structure for reciprocable movements in opposite directions, one end of said bar being operatively associated with said latch bolt and its other end being operatively associated with said manually operable lock actuating means; and (k) a pivoted arm extension carried by the other end of said bar and connected with said bolt actuating lever for movement thereby to an active position when the main bolt is in an unlocked position, and an inactive position when the main bolt is in a locked position, and in said active position being engageable by said actuating camming arm and operable thereby to move the latch actuator bar in a direction to actuate the latch bolt to a non-latched position.

* * * * *